US005830044A

United States Patent [19]

Rohde et al.

[11] Patent Number: 5,830,044

[45] Date of Patent: Nov. 3, 1998

[54] ROLL GRINDING MACHINE

[75] Inventors: Wolfgang Rohde, Dormagen; Dieter Rosenthal, Niederfischbach; Hans-Jürgen Bender, Olpe, all of Germany

[73] Assignee: SMS Schloemann-Siemag Aktiengesellschaft, Düsseldorf, Germany

[21] Appl. No.: 766,578

[22] Filed: Dec. 12, 1996

Related U.S. Application Data

[63] Continuation of Ser. No. 430,732, Apr. 28, 1995, abandoned.

[30] Foreign Application Priority Data

Apr. 28, 1994 [DE] Germany ..... 44 14 838.0

[51] Int. Cl.[6] ..... D24B 5/00

[52] U.S. Cl. ..... 451/642; 451/424

[58] Field of Search ..... 451/424, 425, 451/426, 427, 142, 143, 49, 124

[56] References Cited

U.S. PATENT DOCUMENTS

| | | | |
|---|---|---|---|
| 1,327,919 | 1/1920 | Freeland | 451/427 |
| 1,854,618 | 4/1932 | McGradi | 451/142 |
| 1,954,716 | 4/1934 | Stoughton | 451/427 |
| 1,963,781 | 6/1934 | Evans | 451/427 |
| 3,089,293 | 5/1963 | Hoier et al. | 451/142 |
| 3,333,370 | 8/1967 | Parrella | 451/142 |
| 3,534,505 | 10/1970 | Woodford | 451/142 |
| 3,552,066 | 1/1971 | Gladstone | 451/142 |
| 3,660,947 | 5/1972 | Clark, Jr. | 451/142 |
| 3,660,948 | 5/1972 | Clark, Jr. | 451/142 |
| 3,664,066 | 5/1972 | Clark, Jr. | 451/142 |
| 4,077,163 | 3/1978 | Bennett, Jr. et al. | 451/142 |
| 4,218,850 | 8/1980 | Sakai et al. | 451/142 |
| 4,972,631 | 11/1990 | Schwär | 451/124 |
| 5,024,027 | 6/1991 | Hofsess et al. | 451/124 |

FOREIGN PATENT DOCUMENTS 3406160 8/1984 Germany .

*Primary Examiner*—Timothy V. Eley
*Assistant Examiner*—Derris H. Banks
*Attorney, Agent, or Firm*—Friedrich Kueffner

[57] ABSTRACT

A grinding machine for the rolls of a roll stand includes a guide unit extending parallel to the roll to be ground. Mounted on the guide unit is a grinding unit which is displaceable in longitudinal direction of the roll by a displacement drive. The grinding unit is adjustable relative to the roll by adjusting drives. The guide unit is provided with a rotary drive which is capable of rotating the guide unit about its longitudinal axis. The grinding unit is formed by a grinding element which is symmetrical with respect to rotation. The grinding element is connected to the guide unit in such a way that the grinding element and the guide unit rotate together.

12 Claims, 4 Drawing Sheets

ROLL GRINDING MACHINE

This is a continuation of application Ser. No. 08/430,732 filed Apr. 28, 1995 now abandoned.

BACKGROUND OF THE INVENTION

1. Field of the Invention

The present invention relates to a grinding machine for the rolls of a roll stand. The grinding machine includes a guide means extending parallel to the roll to be ground. Mounted on the guide means is a grinding means which is displaceable in longitudinal direction of the roll by means of a displacement drive. The grinding means is adjustable relative to the roll by means of adjusting drives.

2. Description of the Related Art

A grinding machine of the above-described type is known, for example, from German Patent 34 06 160. In this grinding machine, a grinding belt is used which is placed into contact with the roll to be ground through a complicated drive and guide unit. The grinding belt is not an endless belt. This grinding machine has the disadvantage that the grinding belt is quickly rolled off from a supply roll and must subsequently be rewound in a complicated manner or must be replaced.

Also known in the art are grinding elements which are driven so as to rotate. However, in that case, several of these grinding elements are mounted on a support, wherein a drive motor is provided for each grinding element. The grinding elements are driven in such a way that they oscillate over short areas along the roll to be ground. For this purpose, it is necessary to provide flexible electrical supply lines to the drives which are capable of compensating for the axial movements. These electrical supply lines are susceptible to trouble.

SUMMARY OF THE INVENTION

Therefore, it is the primary object of the present invention to provide a grinding machine of the above-described type which is simple, safe and inexpensive.

In accordance with the present invention, the guide means is provided with a rotary drive which is capable of rotating the guide means about its longitudinal axis. The grinding means is formed by a grinding element which is symmetrical with respect to rotation. The grinding element is connected to the guide means in such a way that the grinding element and the guide means rotate together.

As a result of the configuration according to the present invention, it is ensured that the rotary drive for the grinding element which is longitudinally movable on the guide means is stationary in axial direction. In addition, several grinding elements may be driven by one motor.

In accordance with an advantageous feature of the present invention, the guide means is constructed as a tubular or hollow shaft, the grinding means interacts with a drive member which projects into a slot of the tubular shaft, and the displacement drive acts on the drive member. This feature provides a simple engagement of the displacement drive with the grinding element.

In accordance with another feature, a nut which interacts with the drive member is arranged in the hollow shaft, the nut surrounds a spindle and the spindle is rotatable by means of the displacement drive. This feature provides a possibility of transposing rotations into axial displacement movements which is particularly easy to maintain.

Another feature provides that a coupling, preferably a slip coupling, is provided between the displacement drive and the spindle. As a result, damage to the grinding machine is prevented in the case that extreme operating conditions should occur.

In accordance with another feature, sensors are provided for monitoring the displacement movement of the grinding element, wherein the displacement drive is reversed when the sensors respond. These sensors, usually constructed as switches, make it possible to reverse the axial displacement direction through a control unit.

In order to ensure that no irregularities caused by malfunctions can occur during the grinding procedure, the drive forces and displacement forces are transmitted through oscillation-compensating elements, such as, toothed belts.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
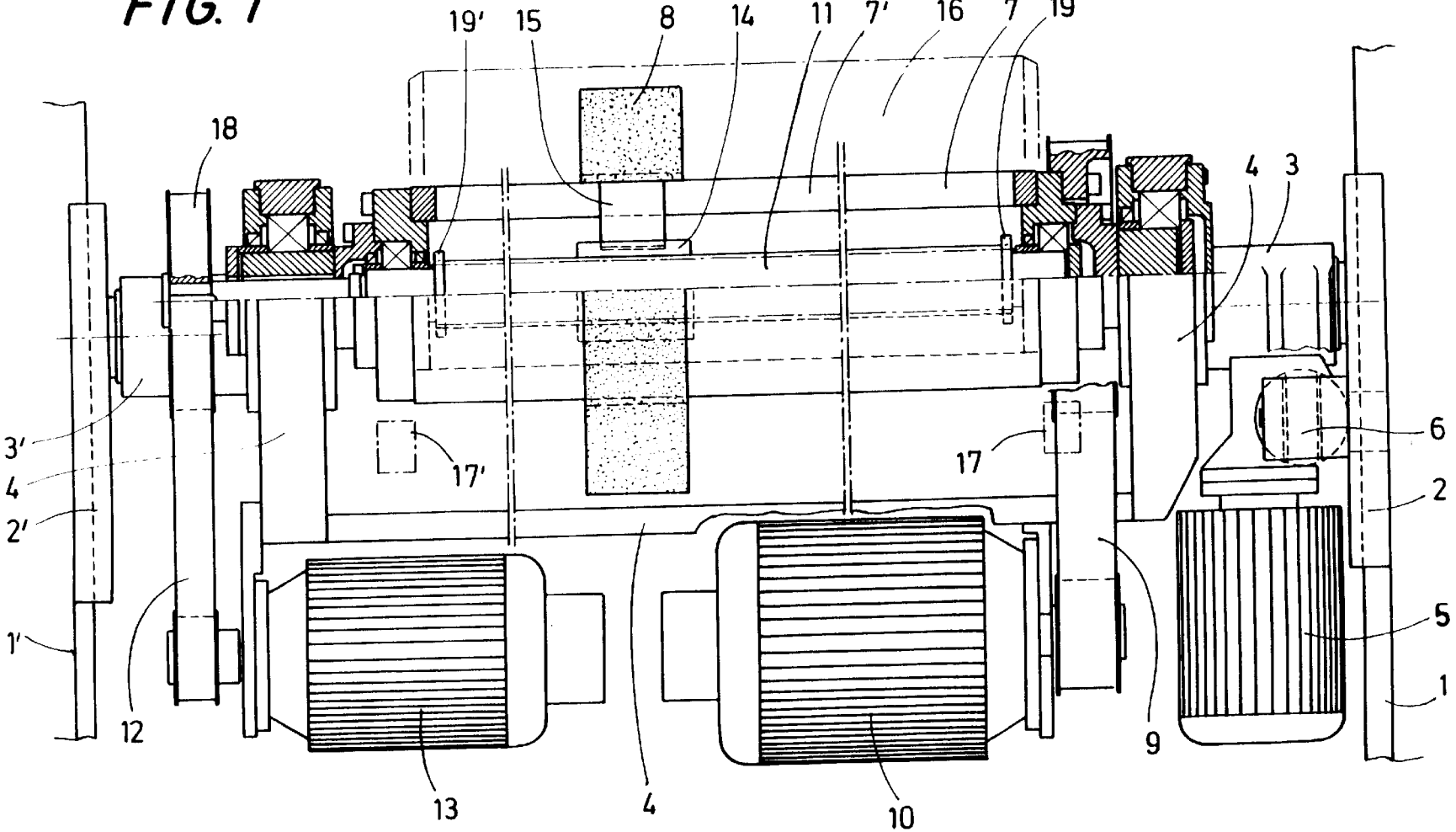
FIG. 1 is a schematic view, partially in section, of a grinding machine according to the present invention mounted in a roll stand.
Figure 2:
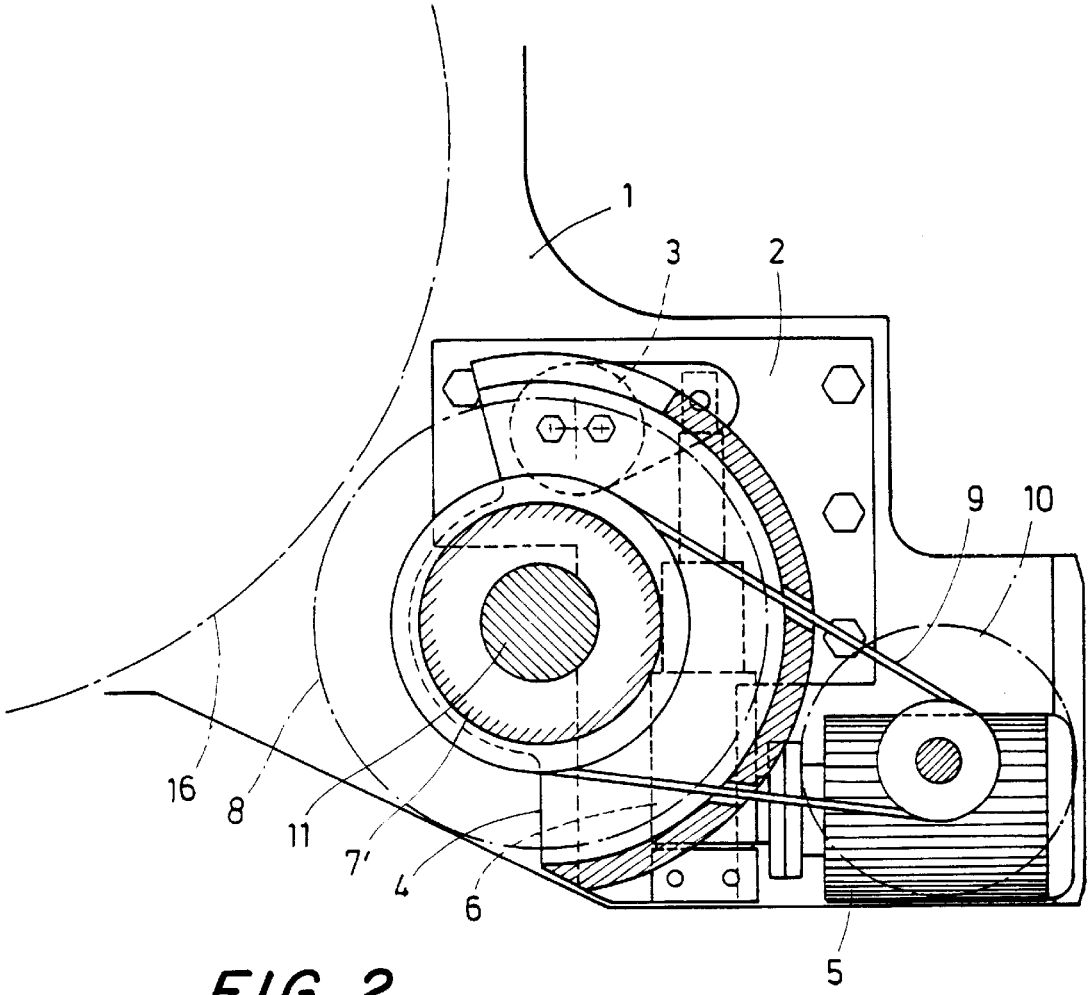
FIG. 2 is a side view, partially in section, of the grinding machine of FIG. 1.
Figure 3:
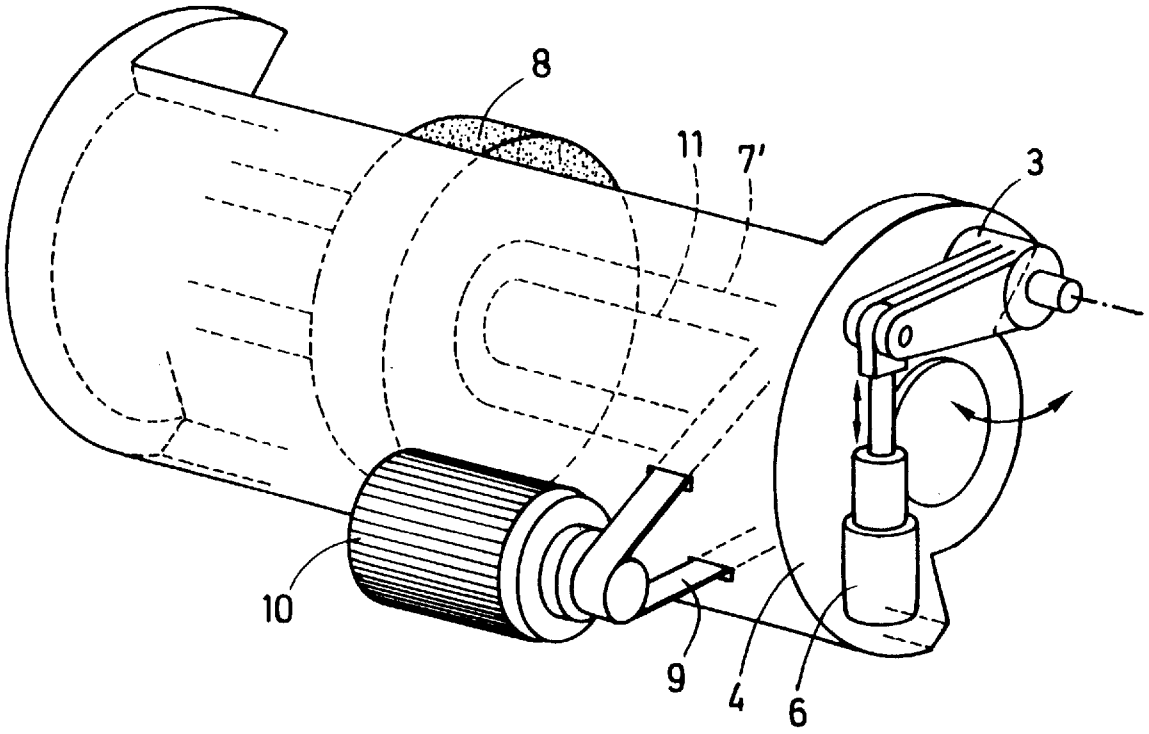
FIG. 3 is a perspective view of the grinding element of the grinding machine.

FIGS. 1 and 2 of the drawing show portions of chocks 1, 1' of a roll stand in which a changeable cassette 2, 2' is mounted. The changeable cassette 2, 2' supports the necks 3, 3' of a link 4. An adjusting drive 5 is mounted on the changeable cassette 2 and acts on the neck 3 through a gear unit 6, as shown particularly in FIG. 3.

Figure 4:
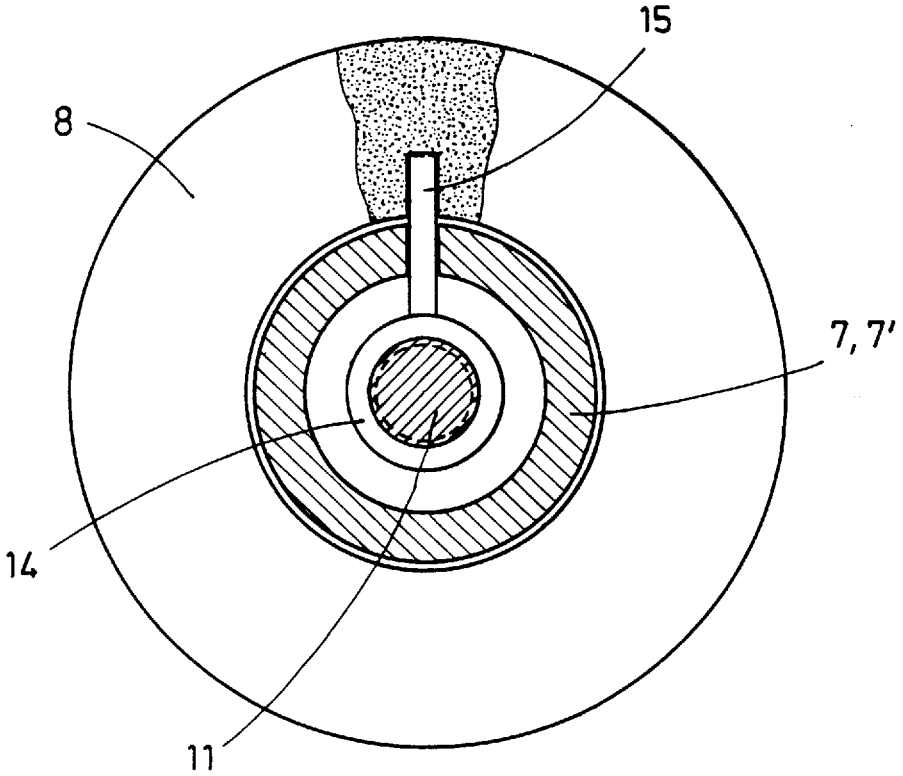
FIG. 4 is a sectional view of the grinding machine of FIG. 1.

A guide member 7 is rotatably mounted in the link 4. A grinding element 8, for example, a grinding mop, is mounted on the guide member 7 so as to be non-rotatable relative to the guide member 7, but displaceable in axial direction. The guide member 7 is a tubular shaft 7' which is provided with a longitudinal slot, shown in FIG. 4, and which is drivable through a toothed belt 9 by a rotary drive 10.

A threaded spindle 11 is mounted in the tubular shaft 7'. The threaded spindle 11 is driven for rotation through a toothed belt 12 by means of a displacement drive 13 which is mounted on the link 4. A recirculating ball nut 14 is mounted on the threaded spindle 11. The recirculating ball nut 14 is connected to the grinding element 8 through a drive member 15 which projects into the tubular shaft 7' in the area of the slot.

The grinding machine operates as follows:

By using the adjusting drive 5, the link 4 can be swivelled in such a way that the grinding element 8 is adjusted relative to the roll 16. The rotary drive 10 places in rotary motion the guide member 7 and, thus, the grinding element 8. Simultaneously, the displacement drive 13 drives the threaded spindle 11.

When the guide member 7 and the threaded spindle 11 are operated at the same rate of rotation, the grinding element, which is in operative connection through the drive member 15 and the recirculating ball nut 14 with the threaded spindle 11, remains in an axial position of rest. As soon as the displacement drive 13 raises or lowers the rate of rotation of the threaded spindle 11 relative to the rate of rotation of the guide member 7, the recirculating ball nut 14 is displaced on the threaded spindle 11 and, in turn, displaces the grinding element 8.

When the grinding element 8 reaches one of the ends of the guide member 7, the grinding element is in the range of one of the sensors 17, 17' which are constructed as switching cams. Through a control, not shown, the sensors 17, 17' influence the rate of rotation of the displacement drive 13 in dependence on the rate of rotation of the rotary drive 10 in such a way that the grinding element 8 is moved in the opposite direction.

In the event that the sensors 17, 17' switch too late or do not switch for reasons of a defect, a collar 19 is provided at each end of the threaded spindle 11, wherein the reciprocating ball nut 14 rests against the collar 19, so that damage of the support of the threaded spindle 11 and of the tubular shaft 7' is avoided. In addition, a slip coupling 18 ensures that the operative connection from the rotary drive 10 through the toothed belt 9, the guide member 7, the drive member 15, the recirculating ball nut 14, the threaded spindle 11, the toothed belt 12 to the displacement drive 13 is not completely rigid, so that damage to the grinding machine is avoided.

The invention is not limited by the embodiments described above which are presented as examples only but can be modified in various ways within the scope of protection defined by the appended patent claims.

We claim:

1. A grinding machine for grinding a roll of a roll stand, the grinding machine comprising a guide means having a longitudinal axis, the guide means extending parallel to the roll, a grinding means and a displacement drive for displacing the grinding means in a longitudinal direction of the roll, an adjusting drive for adjusting the grinding means relative to the roll, a rotary drive for rotating the guide means about the longitudinal axis thereof, the grinding means comprising a grinding element which is rotationally symmetrical, and means for connecting the grinding element to the guide means so that the grinding element and guide means rotate together, wherein the guide means comprises a tubular shaft, the tubular shaft having a slot, a drive member projecting through the slot of the tubular shaft, the grinding element being connected to the drive member, and wherein the displacement drive is operatively connected to the drive member.

2. The grinding machine according to claim 1, further comprising a nut mounted in the tubular shaft, the nut being operatively connected to the drive member, a spindle being surrounded by the nut, wherein the spindle is connected to the displacement drive for rotating the spindle.

3. The grinding machine according to claim 2, wherein the nut is a recirculating ball nut and the spindle is a threaded spindle.

4. The grinding machine according to claim 2, comprising a coupling mounted between the displacement drive and the spindle.

5. The grinding machine according to claim 1, comprising sensors for monitoring a displacement movement of the grinding element and for reversing the displacement drive when the sensors respond.

6. The grinding machine according to claim 1, comprising oscillation-compensating elements between the rotary drive and the guide means and between the displacement drive and the grinding means.

7. The grinding machine according to claim 6, wherein the oscillation-compensating elements are toothed belts.

8. The grinding machine according to claim 1, wherein the guide means is adjustable into the roll.

9. The grinding machine according to claim 1, comprising a link having two arms, the guide means being mounted between the two arms of the link, wherein the adjustment drive is operatively connected to the link.

10. The grinding machine according to claim 9, wherein the roll stand comprises chocks supporting the roll, the link having a fulcrum, the link being mounted at the fulcrum thereof in the chocks.

11. The grinding machine according to claim 1, wherein the grinding machine is mounted in an exchangeable cassette and the grinding machine and the exchangeable cassette are mounted together in the roll stand.

12. The grinding machine according to claim 1, wherein the roll stand comprises chocks, the grinding machine being mounted in an exchangeable cassette, wherein the grinding machine and the exchangeable cassette are mounted together between the chocks.

* * * * *